US006263606B1

(12) United States Patent
Aigner

(10) Patent No.: US 6,263,606 B1
(45) Date of Patent: Jul. 24, 2001

(54) PISTOL HAVING A PRESTRESSED FIRING BOLT

(75) Inventor: Friedrich Aigner, Valentin (AT)

(73) Assignee: Steyr Mannlicher AG & Co KG, Vienna (AT)

( * ) Notice: Subject to any disclaimer, the term of this patent is extended or adjusted under 35 U.S.C. 154(b) by 0 days.

(21) Appl. No.: 09/343,670

(22) Filed: Jun. 30, 1999

(30) Foreign Application Priority Data

Jul. 14, 1998 (AT) ..... 479/98 U

(51) Int. Cl.[7] ..... F41A 3/00

(52) U.S. Cl. ..... 42/69.02

(58) Field of Search ..... 42/69.02

(56) References Cited

U.S. PATENT DOCUMENTS

| | | | | |
|---|---|---|---|---|
| 2,584,299 | * | 2/1952 | Sefried, II | 42/69.02 |
| 2,785,605 | * | 3/1957 | Jourdat | 42/69.02 |
| 3,027,811 | * | 4/1962 | Young | 42/69.02 |
| 5,906,066 | * | 5/1999 | Felk | 42/69.02 |

FOREIGN PATENT DOCUMENTS

| | | |
|---|---|---|
| 395909 | 4/1983 | (AT) . |
| 0730135 | 2/1996 | (EP) . |

* cited by examiner

*Primary Examiner*—Michael J. Carone
*Assistant Examiner*—Denise J Buckley
(74) *Attorney, Agent, or Firm*—Bachman & LaPointe, P.C.

(57) ABSTRACT

A pistol comprises a housing and a slide which slides on this housing and contains the barrel and the breech, in which case the breech has a mainspring and a firing bolt, and a trigger acts via a trigger rod on the trigger device.

8 Claims, 3 Drawing Sheets

PISTOL HAVING A PRESTRESSED FIRING BOLT

BACKGROUND OF THE INVENTION

The invention relates to a pistol, comprising a housing containing a trigger device and comprising a slide which slides on the housing and contains the barrel and the breech, in which case the breech is provided with a firing bolt which can be driven by a mainspring, and a trigger acts via a trigger rod on a trigger device, which trigger device has a trigger stop having a tab which engages in the movement path of the firing bolt.

Self-loading pistols without hammers have the advantage of simple construction and operation in comparison with those of a hammer or a hammer action. They operate using a "double action" or "single action" mode, or intermediate forms. In the former case, when the trigger is operated, the mainspring is first of all loaded, and the shot is automatically fired after passing through the trigger movement. This involves a long cocking movement and a high trigger operating force, which place a strain on the trigger finger. This method of operation is thus predominantly used by the authorities, and is less suitable for the civil market.

In the second case, the mainspring is cocked by the breech moving backward and forward and is held in the cocked position by the trigger stop, until the shot is fired by operating the trigger. However, since the mainspring must be strong in order to provide the required firing energy, the trigger operating weight is considerable. Safety measures are, of course, of major importance in this mode.

AT 395 909 B (GLOCK) discloses a pistol of this generic type, in which the mainspring is half-cocked in advance and, during operation of the trigger, the second half of the initial cocking process is carried out first, and the shot is then fired, for which purpose the trigger rod has a slotted link, and a complicated and filigree mechanism is provided for the first half of the initial cocking process. As a result of the partial precooking process, and despite a relief spring which is provided specifically for this purpose, the work that has to be carried out by the trigger finger is admittedly somewhat reduced in terms of force and movement, but this does not result in the shot being fired with precision.

EP 730 135 A1 (WALTHER) discloses a further pistol of this generic type, which can be operated using both the "double action" and "single action" mode. For the former mode, a trigger rod is provided which interacts with the firing bolt and is guided by a slotted link while, for the second mode, a trigger stop is provided which rests on a support and can only pivot. During operation of the trigger, there is an initial very long slack movement, as a result of the kinematics, before the support is tilted away by the action of the trigger rod, during which process considerable friction and lever-arm influences have a disturbing effect. The mechanism, which has a large number of parts and whose dimensions are critical, is intended to allow the transition or easy changeover from the one operating mode to the other.

It is an object of the present invention to improve a pistol without a hammer such that a major improvement is achieved in the trigger characteristic while satisfying stringent safety requirements and with a design that is as simple as possible.

SUMMARY OF THE INVENTION

The foregoing object is achieved according to the invention wherein:

(a) a trigger stop is guided in the housing such that it can move in the longitudinal direction and can pivot downward, and is biased on upward by a first spring;

(b) a threshold is provided, which is fixed to the housing and interacts with a ramp on the trigger stop so that, during operation of the trigger, the trigger stop is first of all moved in the longitudinal direction and, after passing over the threshold, the trigger stop pivots downward;

(c) a drag lever is provided in front of the trigger stop, and pivots about a shaft that is fixed to the housing, is loaded to the rear, toward the trigger stop, by a second spring, has an apex edge at a distance from its axis and, in its furthest-forward position, is supported on the housing; and (d) at the front, the trigger stop has a small tab which rests on the apex edge of the drag lever when the trigger stop and the drag lever are located in a rear position.

The required parts are few in number and they are also simple and cheap to manufacture while being suitable for installation by machine. The major advantages of this design result from the interaction of all the parts, see the functional description further below. In particular, the ramp according to feature b) ensures that shots are fired with precision with a short and dry shot firing movement, the second spring according to feature c) reduces the trigger operating weight to a noticeable extent, and the small tab according to feature d) by interacting with the first spring in accordance with feature a), ensures that the trigger stop returns to the safe initial position again. Finally, the trigger mechanism can be changed over even more easily to the "double-action" mode, by removing the drag lever and installing a longer trigger stop.

In an embodiment of the invention, the threshold which is fixed to the housing is formed as a bolt with a circular cross section, and the ramp is designed as an edge at an obtuse angle. This feature further reduces the cost of manufacture and, despite shots being fired with precision, and the high accuracy, achieves a smooth transition from the initial trigger movement to firing.

In a further preferred embodiment, the firing bolt has a lug with an inclined actuating surface, and the tab of the trigger stop has an inclined actuating surface, and the inclination angles of these two actuating surfaces and the obtuse angle of the edge are approximately the same. This feature results in a further improvement in the trigger since, during rearward movement, the trigger stop slides on the lug, and downward on the obtuse angle. The friction force is thus distributed over a longer distance and, despite the rearward movement, no further cocking of the mainspring takes place, which would increase the trigger weight.

A further improvement in safety and operating convenience is achieved in that the trigger stop has a recess with a pushing surface at the rear and a control surface further forward, and that end of the trigger rod which interacts with the trigger stop can be placed against the pushing surface so that the end of the trigger rod disengages while the trigger stop is pivoting downward. As a consequence, at the moment of release, the trigger rod is decoupled from the trigger stop, and is automatically coupled again on reaching the ready-to-fire position. This improves safety, to a particularly major extent, if the front end of the trigger rod is articulated on the trigger and the trigger is provided with a trigger safety device. This also provides complete safety if the pistol is dropped.

In a further development of the invention, the trigger weight can be adjusted, in that the force exerted by the second spring can be adjusted by means of an adjusting screw which acts on its second limb and if the force exerted by the second spring is less than the force of the mainspring.

BRIEF DESCRIPTION OF THE DRAWINGS

The invention will be described and explained in the following text with reference to illustrations, in which.

DETAILED DESCRIPTION

Figure 1:
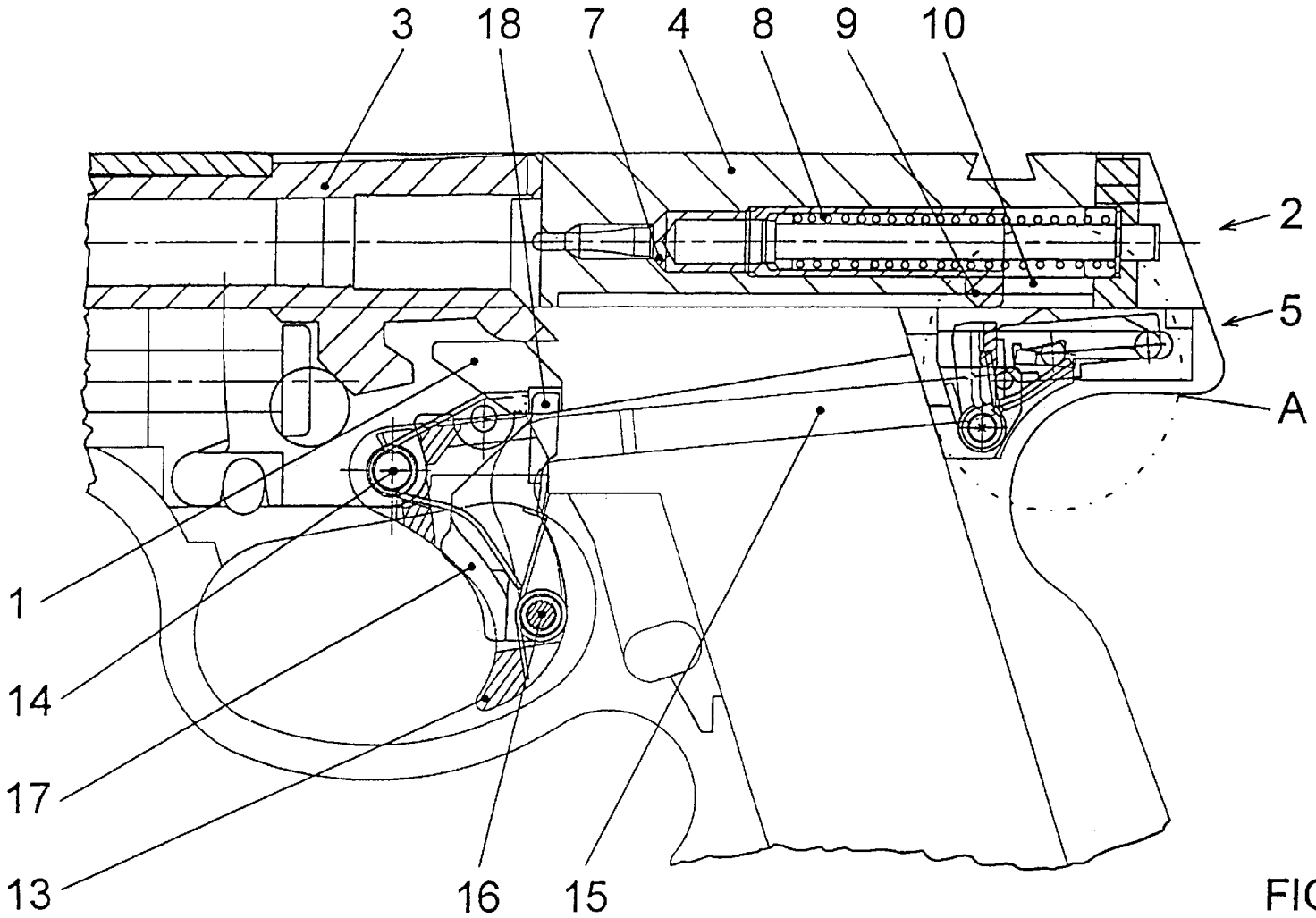
FIG. 1—shows a longitudinal section through a pistol according to the invention.

In FIG. 1, a part of the housing is denoted by 1, and a slide which is guided on it is denoted by 2. The slide 2 contains, in a known manner, a lockable barrel 3 and a breech 4, which interacts with a trigger device which is denoted in generic form by 5. In the breech 4, a firing bolt is guided such that it can be moved against the force of a mainspring 8, and is provided with a lug 9, which projects downward through a slot 10 in the breech 4 into the region of the trigger device. The term housing is generic and is used in the kinematic sense since, depending on the material, the housing may be manufactured integrally or from plastic with appropriate metallic inserts.

A trigger 13 is mounted in the housing 1 such that it can pivot about a trigger shaft 14, and is connected via a pin 16 to a trigger rod 15 which is bent at the front. A trigger protection device 17 is mounted in the trigger 13 such that it can pivot about the pin 16, its locking tooth 18 interacts in a known manner with the housing 1 and thus prevents trigger operation unless the trigger protection device is also operated. In the position shown, the trigger safety device has been opened, so that the trigger can be moved.

Figure 2:
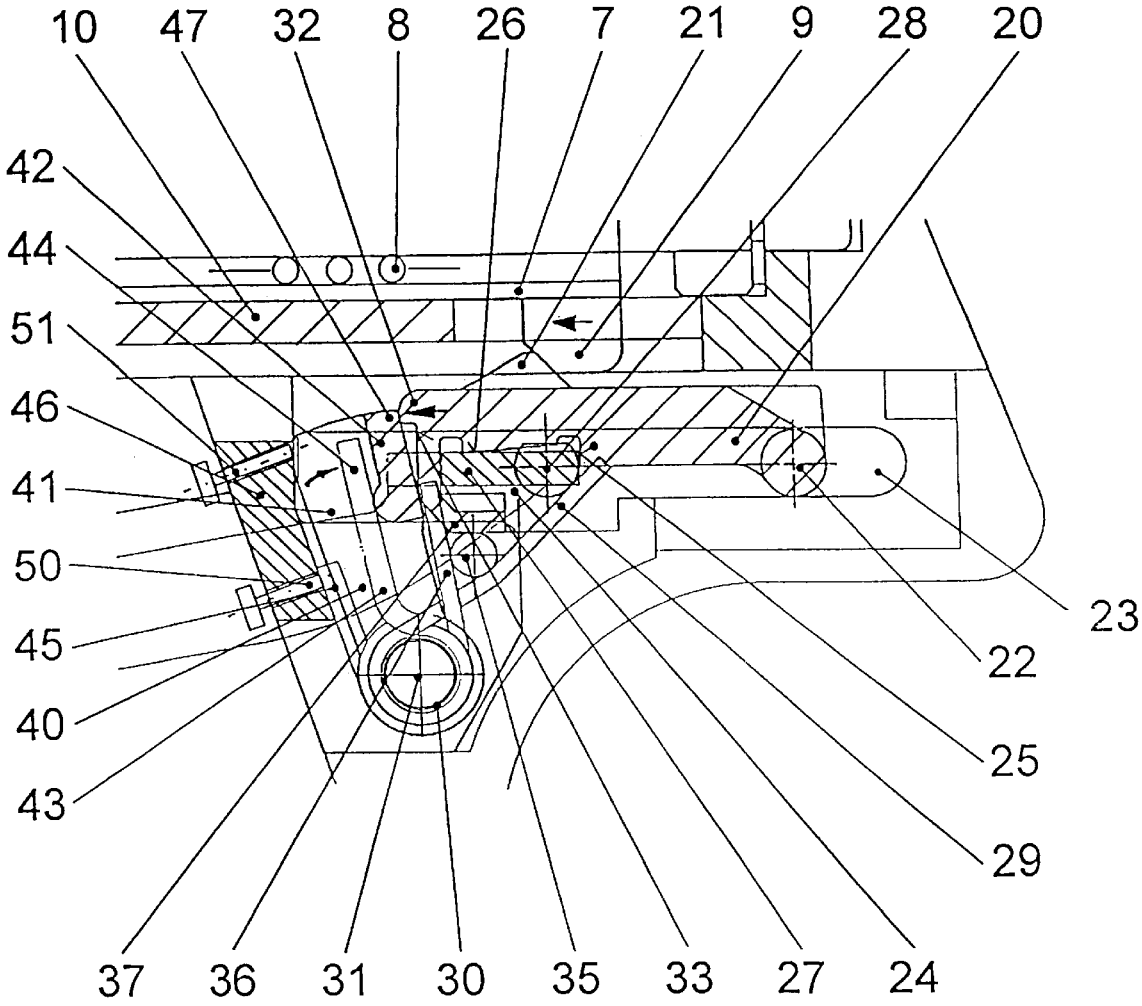
FIG. 2—shows the detail A in FIG. 1, enlarged, in a first position.

FIG. 2 shows the trigger device 5 of FIG. 1, indicated by A, in detail. A trigger stop 20 with a tab 21 at the top (this has a common actuating surface with the lug 9) is guided by means of two stubs 22 (which are arranged on both sides at its rear end) such that it can move longitudinally in grooves 23 in the housing, and can pivot about the stubs 22. The trigger stop 20 has a recess 24 which is accessible from underneath and is essentially bounded by a pushing surface 25 and a control surface 26 in which the one, bent, end 27 of the trigger rod 15 engages. Furthermore, a transverse piece 28 is provided, on which the first limb 29 of a first spring 30 acts and exerts a force directed forward/backward on it. The first spring 30 is in this case a hairpin spring whose center part loops around a transverse bolt 31, which is at the same time a shaft. At its front upper end, the trigger stop has a small tab 32. An essentially vertical breast surface 33 extends under the small tab 32.

A cylindrical pin 35 is arranged fixed in the housing, forming a threshold, and the second limb 36 of the first spring 30 is supported on it. The threshold 35 interacts with a ramp 37, which is formed by a horizontal limb surface 38 and by a rising limb surface 39 which forms an obtuse angle with this horizontal limb surface 38. The obtuse angle is roughly the same as the angle of the interacting actuating surfaces of the tab 21 and of the lug 9.

A drag lever 40 is mounted such that it can rotate about the pivoting shaft 31 which is fixed to the housing, and is mounted in front of the trigger stop 20. This drag lever 40 comprises one or two arms 41 and a bridge 42, on which the first limb 44 of a second spring 43 (in this case also a hairpin spring) acts. Its second limb 45 rests against one part of the housing 1, a housing wall 46. The rear, upper part of the bridge 42 forms an apex edge 47, which interacts with the small tab 32 in a manner which will be described later. The housing wall 46 is used as a stop by the drag lever 40 in its furthest forward position, against which it can be supported, subject to the pressure of the mainspring. A further adjusting screw 50 in the housing wall 46 can be used to act on the second limb of the second spring 43, thus allowing the trigger weight to be adjusted. The initial movement on the trigger can be adjusted by adjusting the stop, and thus the final position, by means of an adjusting screw 51.

The described apparatus operates as follows:

In the position shown in FIG. 2, the apparatus is ready to fire, with the mainspring 8 cocked. The lug 9 is supported on the tab 21. The trigger stop 20 on the one hand rests on the threshold 35 and can thus not pivot downward, and on the other hand rests on the drag lever 40 in the longitudinal direction. Since the mainspring 8 is considerably stronger than the second spring 43, it overcomes the force of the second spring 43 and forces the drag lever 40 forward, where it rests against the housing wall 46 and against the adjusting screw 51. The end 27 of the trigger rod 15 is located in the recess 24 and rests against the pushing surface 25. The entire trigger system is positively locked and is protected by the trigger protection device 17 if the pistol is dropped.

Figure 3:
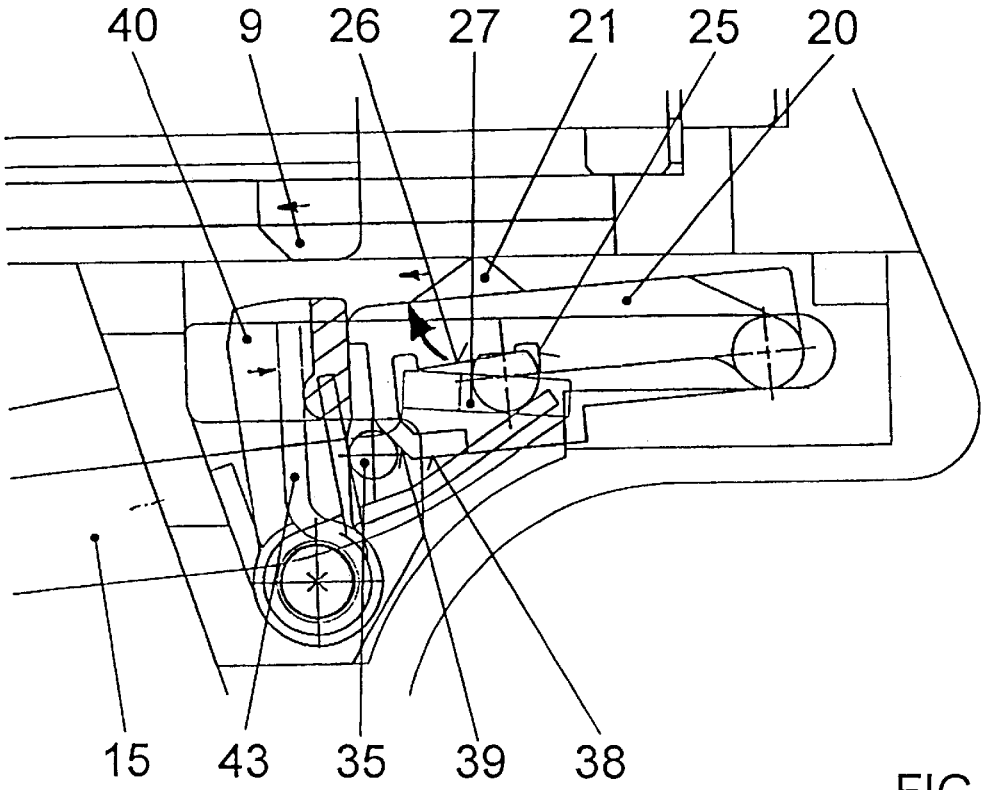
FIG. 3—shows the detail A in FIG. 1, enlarged, in a second position.

If the trigger is now operated, then the trigger rod 15, acting on the pushing surface 25, pushes the trigger stop 20 to the rear, against the force of the mainspring 8, but supported by the second spring 43. As long as the horizontal limb surface 38 of the ramp 37 is guided on the threshold 35, the trigger stop 20 is moved to the rear without any pivoting movement. Only when the horizontal limb surface 38 changes into the rising limb surface 39 is the trigger stop pivoted downward by the force of the mainspring 8, and the tab 21 releases the lug. This position can be seen in FIG. 3. During the downward pivoting movement, the approximately parallel alignment of the rising limb surface 39 and of the actuating surface between the tab 21 and the lug 9 can be seen, in an advantageous manner. During the downward pivoting movement of the trigger stop 20, the bent end 27 of the trigger rod 15 is also forced by the action of the control surface 26 away from the pushing surface 25, so that the connection between the trigger rod 15 and the trigger stop 20 is temporarily interrupted.

Figure 4:
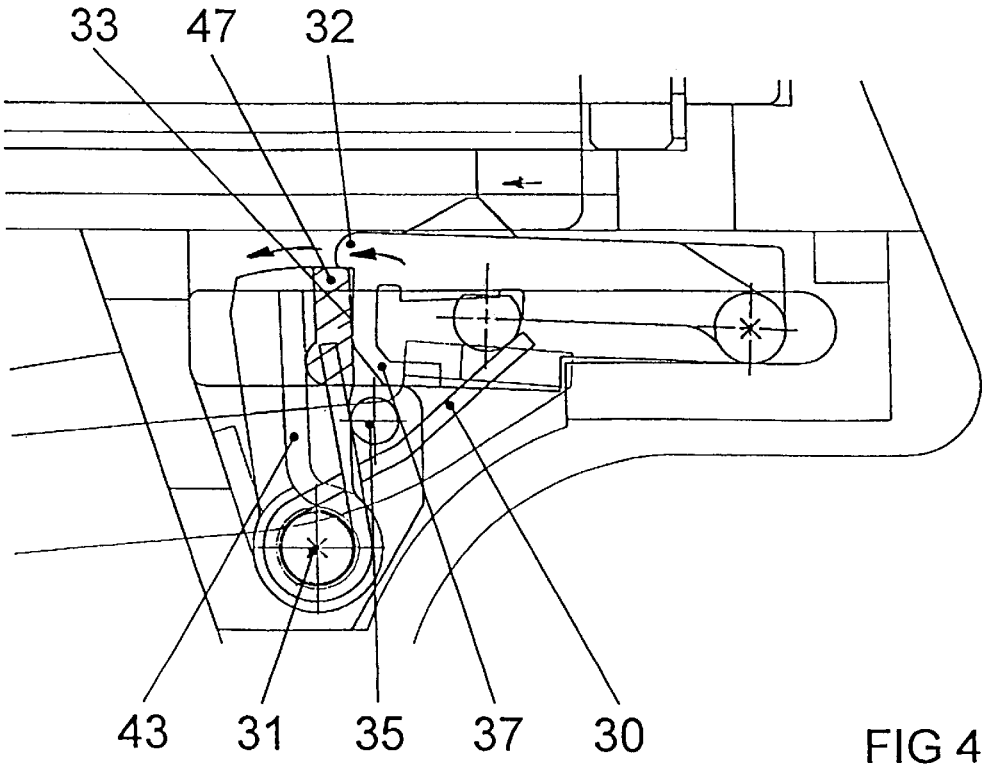
FIG. 4—shows the detail A in FIG. 1, enlarged, in a third position.

FIG. 4 shows what happens after the slide 2 is moved backward, during the cocking of the mainspring 8. As long as the mainspring 8 is still not exerting any force on the trigger stop 20, the latter is pushed entirely to the rear by the second spring 43 and, apart from this, is pushed completely upward by the first spring 30. The apex edge 47 of the drag lever 40 thus moves under the small tab 32 on the trigger stop 20. While the breech 4 moves forward, the lug 9 on the firing bolt 7 comes into contact with the tab 21 of the trigger stop 20 once again, and moves the trigger stop 20 forward. Since the small tab 32 is resting on the apex edge 47, the trigger stop 20 cannot pivot downward, however, and, during the forward movement which is carried out together with the drag lever 40, its ramp 37 is raised above the threshold 35. During this joint forward movement, the breast surface 33, which is adjacent to the small tab underneath and at a shorter distance from the axis 31, results, however, in the apex edge 47 being pulled out under the small tab 32. As a result of the force of the mainspring 8, which has in the meantime increased during the forward movement, the ramp 37 of the trigger stop 20 once again rests, to be precise with its horizontal limb surface 38, on the threshold 35, and thus holds the firing bolt in the cocked position. The state shown in FIG. 2 has now been reached once again.

It is to be understood that the invention is not limited to the illustrations described and shown herein, which are deemed to be merely illustrative of the best modes of carrying out the invention, and which are susceptible of modification of form, size, arrangement of parts and details of operation. The invention rather is intended to encompass all such modifications which are within its spirit and scope as defined by the claims.

What is claimed is:

1. A pistol, comprising a housing containing a trigger device, a slide which slides on the housing and contains a barrel and a breech, wherein the breech is provided with a firing bolt which is driven by a mainspring, and a trigger which acts via a trigger rod on the trigger device, the trigger device having a trigger stop having a tab which selectively engages the firing bolt in the movement path of the firing bolt, the improvement comprises:

(a) actuation means for guiding the trigger stop in the housing such that the trigger stop can move longitudinally with respect to the movement path direction and can pivot downward, and is biased upward by a first spring (30);

(b) a threshold is provided, which is fixed to the housing and interacts with a ramp on the trigger stop so that, during operation of the trigger, the trigger stop is first moved longitudinally and, after passing over the threshold, it pivots downward;

(c) a drag lever provided in front of the trigger stop and is pivoted about a pivot axis on a shaft that is fixed to the housing, the drag lever is loaded, toward the trigger stop by a second spring and has an apex edge at a distance from the pivot axis and, in its furthest-forward position, is supported on a wall of the housing; and (d) the trigger stop has a small tab on its front which rests on the apex edge of the drag lever when the trigger stop and the drag lever are located in a rear position.

2. The pistol as claimed in claim 1, wherein the threshold is formed as a bolt with a circular cross section, and the ramp is formed by two limb surfaces which abut against one another at an obtuse angle.

3. The pistol as claimed in claim 2, wherein the firing bolt has a lug with an inclined actuating surface, and the tab of the trigger stop has an inclined actuating surface, wherein the inclination angles of these two actuating surfaces and of the second limb surface are approximately the same.

4. The pistol as claimed in claim 3, wherein the trigger stop has a recess with a pushing surface at the rear and a control surface further forward, the trigger rod has an end which interacts with the trigger stop wherein the end is placed against the pushing surface so that the end disengages while the trigger stop is pivoting downward.

5. The pistol as claimed in claim 1, wherein the end of the trigger rod is articulated on the trigger, and the trigger is provided with a trigger safety device.

6. The pistol as claimed in claim 1, wherein the force exerted by the second spring can be adjusted by means of an adjusting screw which acts thereon.

7. The pistol as claimed in claim 1, wherein the force exerted by the second spring is less than the force of the mainspring.

8. The pistol as claimed in claim 1, wherein at least one of the first and second springs is a hairpin spring which is threaded onto the shaft on which the drag lever is pivoted.

* * * * *